US007151457B2

(12) United States Patent
Riley et al.

(10) Patent No.: US 7,151,457 B2
(45) Date of Patent: Dec. 19, 2006

(54) DETECTION WARNING SYSTEM FOR CAREGIVERS IN A HOME

(76) Inventors: James A. Riley, 6294 S. Tecumseh Rd., Springfield, OH (US) 45502; Tami L. Randall, 3671 Old Clifton Rd., Springfield, OH (US) 45502

( * ) Notice: Subject to any disclaimer, the term of this patent is extended or adjusted under 35 U.S.C. 154(b) by 167 days.

(21) Appl. No.: 11/053,019

(22) Filed: Feb. 8, 2005

(65) Prior Publication Data

US 2005/0200488 A1 Sep. 15, 2005

Related U.S. Application Data

(60) Provisional application No. 60/552,049, filed on Mar. 10, 2004.

(51) Int. Cl.
*G08B 23/00* (2006.01)

(52) U.S. Cl. ..... 340/573.4; 340/286.07; 340/573.1; 340/556

(58) Field of Classification Search ..... 340/286.07, 340/573.1, 573.4, 556
See application file for complete search history.

(56) References Cited

U.S. PATENT DOCUMENTS

| | | | | |
|---|---|---|---|---|
| 4,196,425 | A * | 4/1980 | Williams et al. | 340/573.4 |
| 5,471,198 | A * | 11/1995 | Newham | 340/573.4 |
| 5,600,305 | A * | 2/1997 | Stafford et al. | 340/573.1 |
| 6,049,281 | A * | 4/2000 | Osterweil | 340/573.4 |
| 2003/0038725 | A1 * | 2/2003 | Slomowitz et al. | 340/686.1 |
| 2004/0178910 | A1 * | 9/2004 | Egger | 340/556 |

* cited by examiner

*Primary Examiner*—Jeffery Hofsass
*Assistant Examiner*—Edny Labbees

(57) ABSTRACT

A detection warning system for caregivers in a home alerting a caregiver when a person exits a room, bed or walk through a doorway. This system comprises of two enclosures and an external reflector. A portable infrared emitter detector enclosure houses an emitter with a narrow, infrared beam, detector and transmitter. A portable receiving enclosure houses a receiver with an adjustable audio alarm. An emitter in the emitter detector enclosure emits an infrared beam to the reflector, which reflects the beam back to the detector. The detector senses when the beam is obstructed from reaching the reflector and energizes the transmitter. The transmitter receives the signal from the transmitter activating the adjustable audio alarm alerting a caregiver.

18 Claims, 7 Drawing Sheets

DETECTION WARNING SYSTEM FOR CAREGIVERS IN A HOME

CROSS-REFERENCE TO RELATED APPLICATIONS

This Application claims priority from U.S. Provisional Application No. 60/552,049 filed on Mar. 10, 2004, entitled "A Detection Warning System for Caregivers in a Home."

BACKGROUND

1. Field of Invention

This invention relates to a detection warning system specifically to a portable system which detects an individual interrupting a narrow, infrared beam and alerts a caregiver anywhere in a home with an adjustable audio alarm.

2. Description of Prior Art

Hospitals have been using monitoring systems to alert a nurses station, however, these monitoring systems will operate only with a patient physically capable of pushing a button to summon a nurse for assistance. The medical industry has objected to these systems since the physically and mentally challenged patient may not be able to utilize this system and patients who roam or fall out of bed will not be able to summon the nurse for help. These systems are not designed for home use.

Originally, these monitoring systems consisted of a push button by the patient's bedside which was wired directly to the nurses station. Pushing the button at the patient's bedside triggered a light or audible alarm at the nurses station.

There have been improvements in these monitoring systems. U.S. Pat. No. 4,947,152 issued to Hodges on Aug. 7, 1990, discloses a patient monitoring system comprised of a detection means installed on a wall of a hospital room which generates an alert signal in response to the presence of a patient in a predetermined zone spaced apart from the hospital bed. This zone is a fan-shaped infrared beam extending from the detection means across the room above the hospital bed. The detection means does not respond to normal patient movement, however, does respond to any person or caregiver entering the room.

U.S. Pat. No. 4,228,426, issued to Roberts on Oct. 4, 1980, discloses a patient monitoring system comprised of a switch installed in a pad positioned in the bedding of a hospital bed underneath the patient. When the patient moves or exits the hospital bed, the switch contacts open generating an alarm signal which alerts the nurses station.

U.S. Pat. No. 5,751,214 issued to Cowley et al., on May 12, 1998, a patient activity monitor with a data processor programmed device which alerts an attendant if a patient moves beyond a certain range.

U.S. Pat. No. 5,600,305 issued to Stafford et al., on Feb. 4, 1997, describes a portable patient monitoring system which alerts a nurse when a patient exits a hospital bed which breaks an infrared beam. A reflector is placed adjacent to the end of the hospital bed. The infrared beam from the emitter runs to the reflector and back to the detector on a path parallel to the side of the hospital bed at a predetermined distance away from the side of the hospital bed. This system is retrofitted into the nurses station similar to the other monitoring systems.

Many of the mentioned monitoring systems, from the expensive programmable data to the pressure pad systems, do not possess reliability, flexibility or ease of use and cannot be used in a home. The infrared and the passive infrared (PIR) systems are relatively inexpensive to manufacture and capable of detecting movement, however, once mounted will remain there permanently. The fan-shaped PIR systems detect any movement in a room, therefore, may trigger false alarms when a nurse enters to assist the patient. False alarms may also be triggered when a patient is receiving visitors. These systems require professional installation into a nurses station, therefore, are not designed for home use.

Several types of monitoring systems have been proposed—for example, U.S. Pat. No. 3,658,052 to Alter (1972) and U.S. Pat. No. 4,196,425 to Williams, Jr. et al., (1980), U.S. Pat. No. 4,228,426 to Roberts (1980), U.S. Pat. No. 4,277,727 to Levert (1981), U.S. Pat. No. 4,377,808 to Kao (1983), U.S. Pat. No. 4,893,005 to Stiebel (1990), U.S. Pat. No. 4,947,152 to Hodges (1990), U.S. Pat. No. 4,978,942 to Bruce (1990), U.S. Pat. No. 5,180,910 to Spratte et al., (1993), U.S. Pat. No. 5,334,972 to Sugimoto et al., (1994), U.S. Pat. No. 5,471,198 to Newham (1995), U.S. Pat. No. 5,486,810 to Schwarz (1996), U.S. Pat. No. 5,600,305 to Stafford et al., (1997), U.S. Pat. No. 5,751,214 to Cowley et al., (1998), U.S. Pat. No. 5,801,629 to Lehmann et al., (1998), U.S. Pat. No. 5,831,535 to Reisman et al., (1998), U.S. Pat. No. 5,933,082 to Abita et al., (1999), U.S. Pat. No. 6,078,261 to Davsko (2000) and U.S. Pat. No. 6,114,963 to Blake et al., (2000).

Although, some of these systems may be inexpensive to manufacture and capable of patient detection, in order for these systems to function properly, such systems must be permanently retrofitted into an existing nurses station. These systems are used in hospitals, however, are not designed for home use. These monitoring systems suffer from a number of other disadvantages:

(a) The manufacturing of data processor systems requires an engineer or technician to program the processor and retrofit into an existing nurses station which would eliminate home use and the need for the portability necessary for caregivers in a home. Manufacturing, installation and repair of this system would prove to be very expensive.

(b) Fan-shaped zone detection systems may detect others in the room and cannot differentiate between the patient, nurse, and visitors which may trigger false alarms. When a nurse or visitor wishes to enter the patient's room, the zone system has to be turned off to approach the patient's bedside, as a result, interfering with patient care. Once installed by a professional into the nurses station, this system becomes permanent. As a result of the zone detection being triggered by a person entering the patient's room, this system would not be suitable for home use.

(c) Installation of a pressure pad sensing device in the hospital bed requires a cable or other transmission means used to connect this sensing device to an external circuit. This cable may interfere with the patient when the patient exits the bed or with the patient's care. If the patient moves or sits up in bed, unwanted signals will trigger a false alarm. Soiled pressure pads must be replaced periodically resulting in additional nurse's time and expense. The pressure pad sensing devices will not activate the alarm when the patient weighs less than a certain prescribed weight.

(d) A patient monitoring system comprising of an array of radiant energy emitters corresponding to an array of radiant detectors installed in a headboard and footboard of a hospital bed becomes a permanent fixture of the bed. Emitters and detectors such as these require professional installation. The zone of infrared energy which covers the bed detects patient movement or a patient's bed coverings which may trigger false alarms. The system has to be turned off when a nurse has to assist the patient. Systems such as this were not intended for home use.

(e) Some patient monitoring systems are designed utilizing individual components. To incorporate all the individual electronic components necessary to manufacture an instrument would not be cost effective, flexible or easy to fabricate. Replacing damaged components would prove to be expensive.

(f) These monitoring systems do not afford the capability of selecting different modes of detection.

(g) The patient monitoring systems are permanently retrofitted into a nurses station, therefore, are not able to operate on an independent battery power pack.

(h) The electronic circuits for most of these patient monitoring systems do not incorporate safety devices such as fuses or circuit breakers. These safety devices are essential to protect the circuitry, patient and may prevent a fire hazard.

OBJECTS AND ADVANTAGES

Several objects and advantages of the present invention are:

(a) to provide a detection warning system whose module design shows evidence of being convenient, rapid, and economical in production;

(b) to provide a detection warning system which is compact, light weight, and provides the portability necessary for caregivers in a home;

(c) to provide a detection warning system which is easy to install and set up for home use, including an alignment light;

(d) to provide a narrow infrared beam from the portable infrared emitter detector base unit (base unit) to the external reflector enabling the caregiver to enter the room or approach the individual's bedside which reduces false alarms;

(e) to provide a prototype detection warning system which has been tested and proven to be reliable, and ready for production;

(f) to provide a detection warning system which does not have to be retrofitted into an existing alarm system;

(g) to provide a detection warning system which provides a choice for mounting, the double-sided adhesive tape or the complete mounting support system which may be rotated to any desirable position;

(h) to provide a detection warning system which may be attached temporarily or permanently on a wall, doorway or bed. The complete mounting support system does not have to be removed from the bed when changing the bed linens, if the bed has to be moved or when an individual exits the bed;

(i) to provide a detection warning system which has a pulse modulated signal which eliminates outside interference and travels through walls and floors;

(j) to provide a detection warning system which allows the caregiver a choice of alternating current power or a direct current battery power pack which may be used for short term use, as well as for a backup supply in case of a power failure and (k) to provide a detection warning system which ensures a caregiver is summoned anywhere in a home by incorporating a continuous adjustable audio alarm and (l) to provide a detection warning system which preserves the individual's dignity.

Further objects and advantages are to provide a detection warning system for a home which has abs fire retardant enclosures, supplies two modes of detection for different sensing ranges, retroreflective and polarized retroreflective, simply by changing a lens, a portable receiving unit may be located anywhere in a home within an approximate 300 foot radius of a portable infrared emitter detector base unit and incorporates receiving lights, and an adjustable audio alarm. Still further objects and advantages will become apparent from a consideration of the ensuing description and drawings.

SUMMARY

Our present invention comprises of a detection warning system for caregivers in a home powered by a 110 volt alternating current wall outlet. A portable infrared emitter detector base unit (base unit) will operate in two distinct modes of detection for different sensing ranges. A portable receiving unit may be located anywhere in a home. This system offers various ways of mounting with a complete mounting support system or double-sided adhesive tape. The base unit emits a narrow, infrared beam which is easily aligned using an alignment light on the base unit and focused on an external reflector located at a predetermined distance. When this narrow, infrared beam is interrupted or obstructed, a pulse modulated signal is sent from a transmitter located in the portable infrared emitter detector base unit to a receiver in the portable receiving unit. Upon receiving this signal from the portable infrared emitter detector base unit, a light and an adjustable audio alarm is activated on the portable receiving unit alerting the caregiver.

DRAWINGS

Drawing Figures

REFERENCE NUMERALS IN DRAWINGS

Figure 1A:
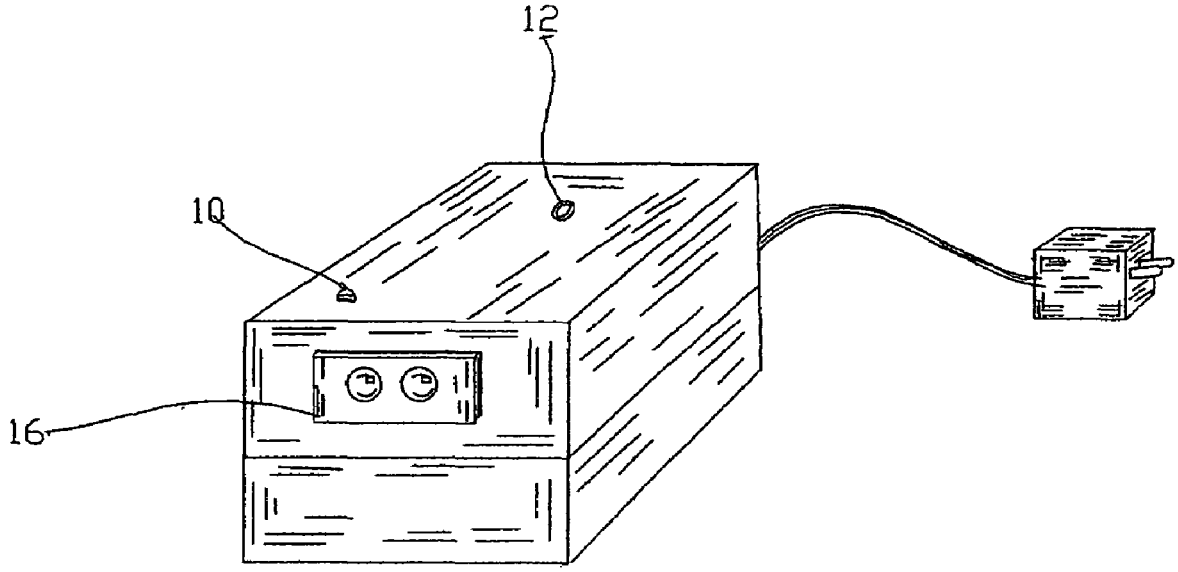
FIGS. 1A and 1B show the front and rear views of the portable infrared emitter detector base unit (base unit).

10 alignment light
12 transmit light
14 power input jack
16 lens screws
18 power switch
20 power indicator light
22 receiving indicator light
24 push button reset switch
26 adjustable audio alarm
28 ball joint tighten screw

30 ball joint mounting support
32 mounting plate
34 support arm mounting nut
36 support arm
38 fastening screws
40 c clamp
42 c clamp tighten screw
44 external reflector
46 0.125 amp fuse
48 2.2K resistor
50 LM317 voltage regulator
52 249 ohm resistor
54 0.1 ufd capacitor
56 1.0 ufd capacitor
58 emitter detector module
60 1K resistor
62 150K resistor
64 15K resistor
66 150K resistor
68 0.01 ufd capacitor
70 NPN transistor
72 4.7K resistor
74 1.0 ufd capacitor
76 555 timer
78 10K resistor
80 NPN transistor
82 relay coil
84 relay contacts
86 transmitter module
88 ground
90 0.125 amp fuse
92 0.1 ufd capacitor
94 LM317 voltage regulator
96 249 ohm resistor
98 2.2K resistor
100 1.0 ufd capacitor
102 1K resistor
104 receiver module
106 1K resistor
108 silicon controlled rectifier
110 1.5K resistor
112 ground

DETAILED DESCRIPTION

Figure 1B:
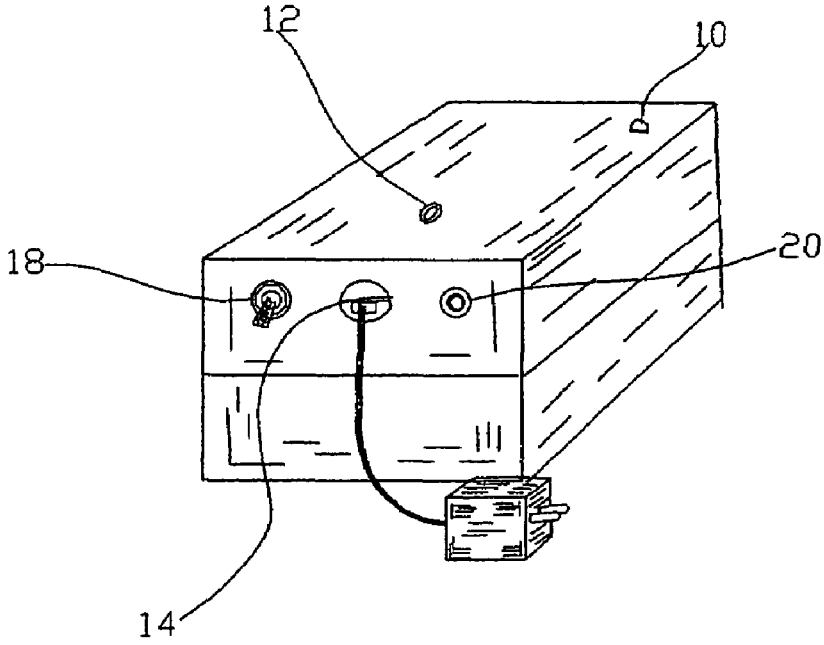

Description—FIGS. 1A and 1B—Preferred Embodiment

A preferred embodiment of the portable infrared emitter detector base unit of the present invention is illustrated in FIG. 1A and 1B. This portable infrared emitter detector base unit houses an emitter and detector (not shown) within an emitter detector module 58 (FIG. 9) which emits a narrow, infrared beam. This narrow, infrared beam is focused through a lens (FIGS. 1A and 2) onto an external reflector 44 (FIGS. 5, 6, 7 and 8). When the portable infrared emitter detector base unit and external reflector 44 are in proper alignment, alignment light 10 will be illuminated. When the narrow, infrared beam is interrupted, the portable infrared emitter detector base unit senses the narrow, infrared beam has been obstructed which activates a transmitter (not shown) in a transmitter module (FIG. 9) transmitting a pulse modulated signal and a transmit light 12 located in the portable infrared emitter detector base unit. This transmitted pulse modulated signal from the portable infrared emitter detector base unit is received by a portable receiving unit (FIG. 3). Power to the portable infrared emitter detector base unit is activated from a power switch 18 (FIG. 1B) which directs power to a power indicator light 20, and an external wall mount transformer through power input jack 14 which receives electricity from a 110 volt alternating current receptacle (not shown) and may be powered by an alternate battery power pack (not shown). This wall mount transformer converts the 110 volt alternating current into +15–18 volts direct current and regulated to +12 volts direct current by an LM317 voltage regulator (FIG. 9) to power the portable infrared emitter detector base unit.

FIG. 2—Embodiment

Figure 2:
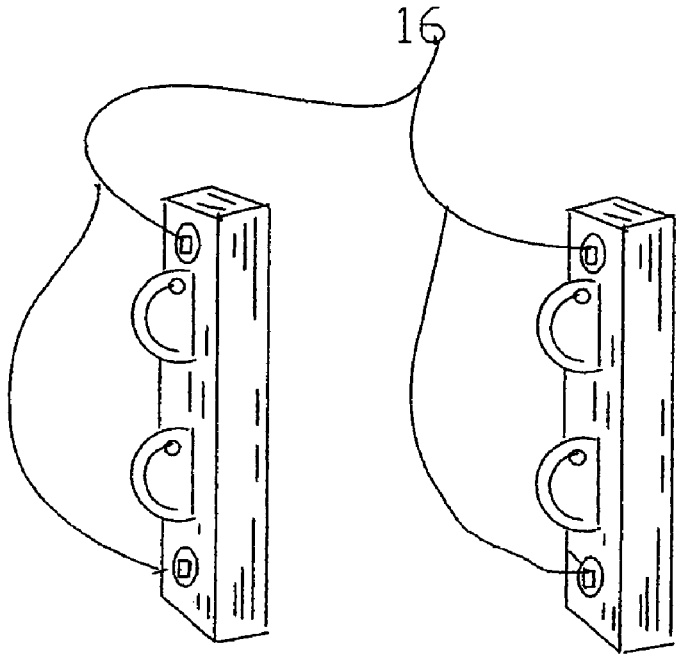
FIG. 2 shows the retroreflective and the polarized retroreflective lenses.
Figure 3:
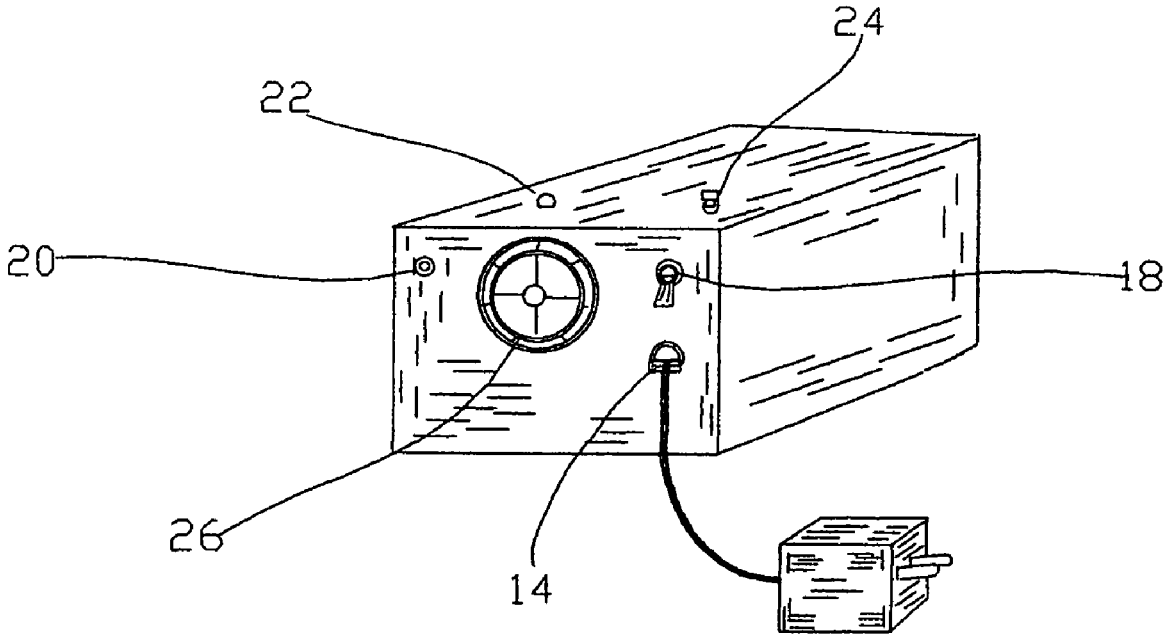
FIG. 3 shows the portable receiving unit.

Interchangeable lenses are represented in FIG. 2. The appearance of the lenses are identical, however, they represent two different modes of detection. To change the lens simply remove two lens screws 16 to change from a retroreflective to a polarized retroreflective mode of detection. Retroreflective incorporates a narrow, infrared beam which may be influenced by ambient light sources reaching the detector (not shown) in the emitter detector module 58 (FIG. 9) within the portable infrared emitter detector base unit (FIGS. 1A and 1B) at a sensing range of approximately 20 feet. Polarized retroreflective ignores ambient light sources which ensures only a narrow, infrared beam reaches a detector (not shown) within the emitter detector module 58 (FIG. 9) within the portable infrared emitter detector base unit (FIGS. 1A and B) reducing the sensing range to approximately 10 feet.

FIG. 3—Embodiment

Figure 10:
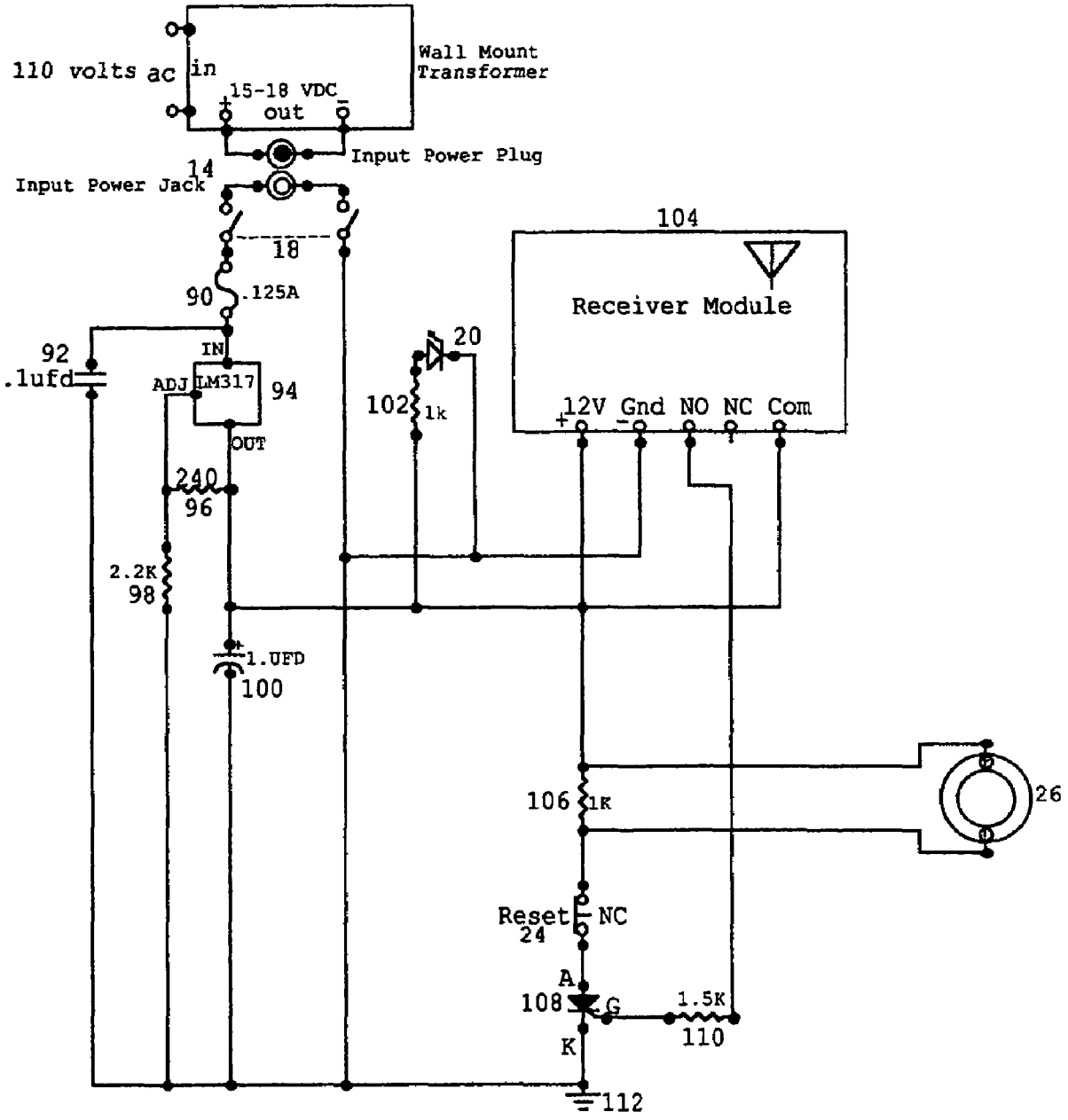
FIG. 10 shows the circuit diagram for the portable receiving unit.

A portable receiving unit FIG. 3 houses a receiver (not shown) within a receiver module 104 (FIG. 10) which receives a pulse modulated signal from the portable infrared emitter detector base unit (FIGS. 1A and 1B) which activates a receiving indicator light 22 which verifies that a signal has been received from the portable infrared emitter detector base unit (FIGS. 1A and 1B). After the signal is acknowledged, the portable receiving unit sounds an adjustable audio alarm 26. This adjustable audio alarm 26 will sound until a push button reset switch 24 is pressed and released. After push button reset switch 24 has been pressed momentarily, the detection warning system is back in the normal operating mode. Power to the portable receiving unit is activated through an external wall mount transformer which receives power from a 110 volt alternating current receptacle (not shown) and converts the 110 volt alternating current into +15–18 volts direct current and regulated to +12 volts direct current by regulator 94 (FIG. 10). Power input jack 14 and power switch 18 activate power indicator light 20. The portable receiving unit may be powered by an alternate battery power pack (not shown).

FIG. 4—Embodiment

Figure 4:
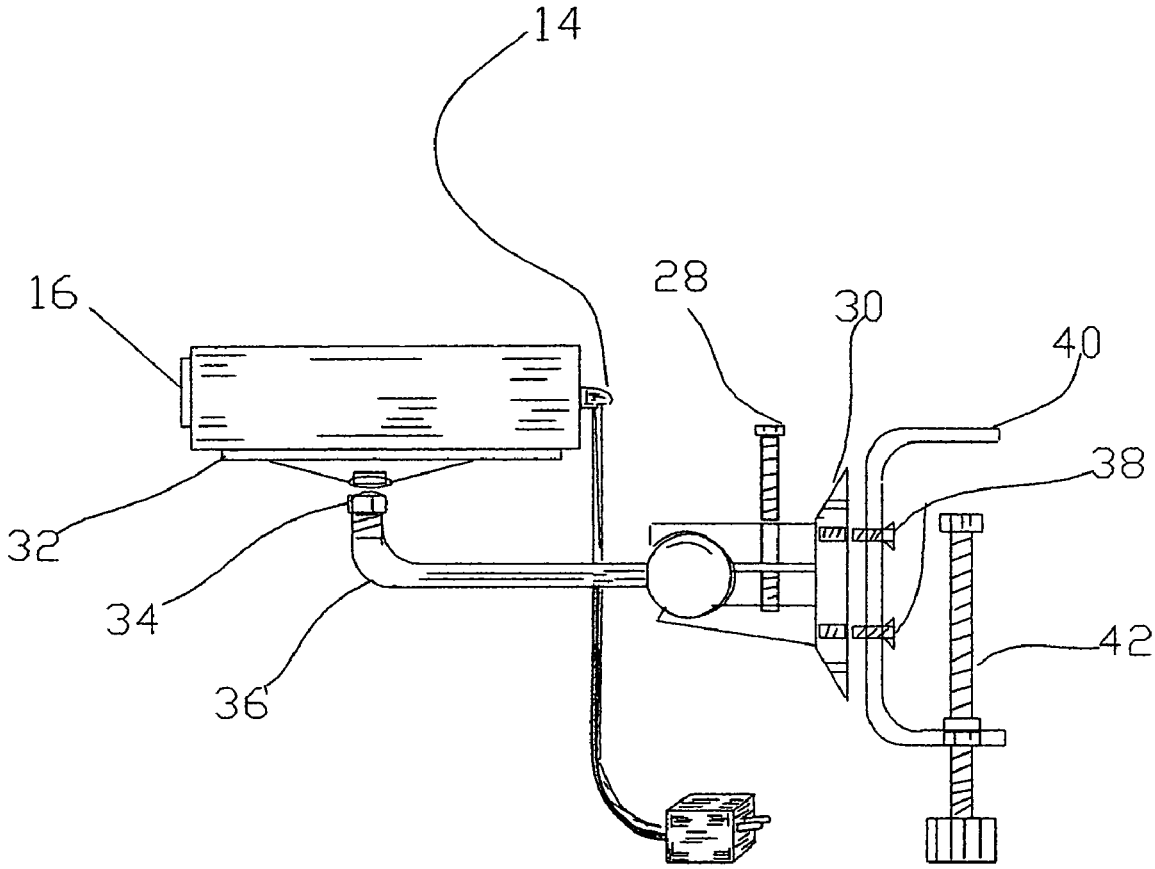
FIG. 4 shows the complete mounting support system.

Embodiment FIG. 4 shows a complete mounting support system. A mounting plate 32 is secured to the portable infrared emitter detector base unit (FIGS. 1A and 1B) with a support arm mounting nut 34, and a support arm 36. Support arm 36 is attached by a ball joint tighten screw 28 to a ball joint mounting support 30. A ball joint mounting support 30 is attached to a c-clamp 40 by fastening screws 38. A c-clamp tighten screw 42 may be adjusted to accommodate various size mounting surfaces.

FIG. 5—Embodiment

Figure 5:
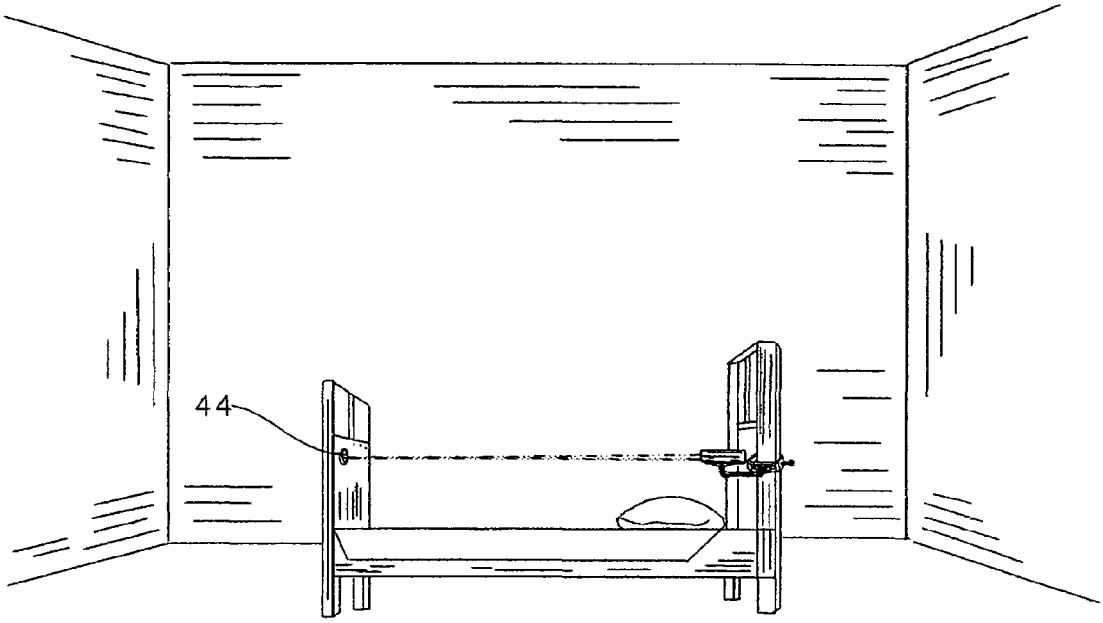
FIG. 5 shows the base unit mounted on the headboard of the bed with the external reflector mounted on the footboard of the bed.

The possibilities for using the detection warning system for caregivers in a home are endless. As illustrated in FIG. 5, the portable infrared emitter detector base unit of the detection warning system for caregivers in a home is attached to a headboard of a bed. As shown, the portable infrared emitter detector base unit is clamped to the headboard of the bed utilizing the complete mounting support system (FIG. 4) aligned with external reflector 44 which is mounted on a footboard of the bed.

FIG. 6—Embodiment

Figure 6:
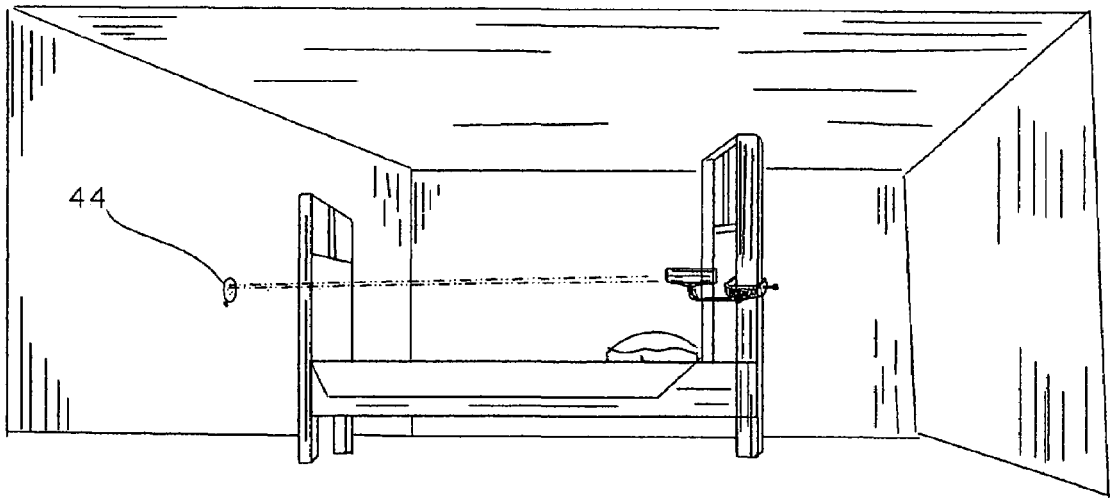
FIG. 6 shows the base unit mounted on the headboard of the bed with the external reflector mounted on the wall.

FIG. 6 shows the portable infrared emitter detector base unit with the complete mounting support system (FIG. 4) aligned with external reflector 44 mounted on a wall.

Figure 7:
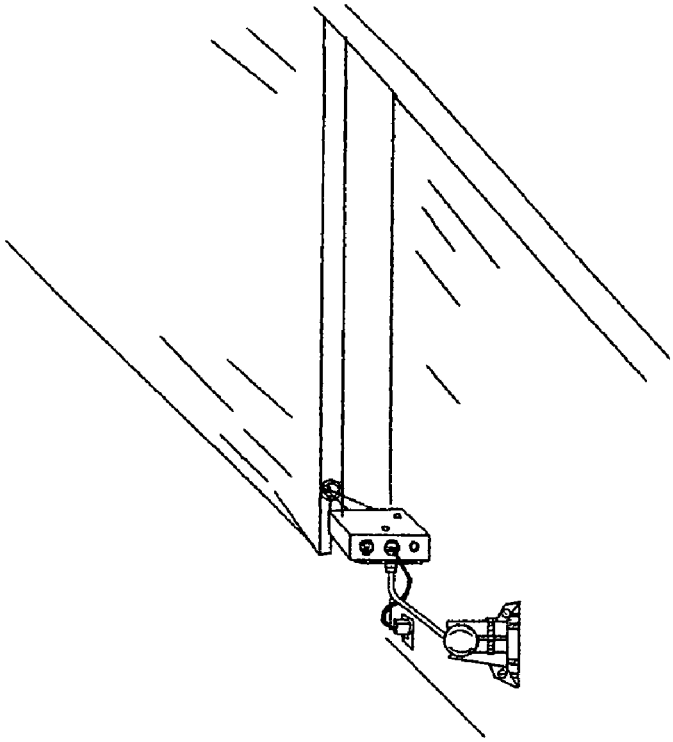
FIG. 7 shows the base unit mounted on the wall utilizing the complete mounting support system.
Figure 8:
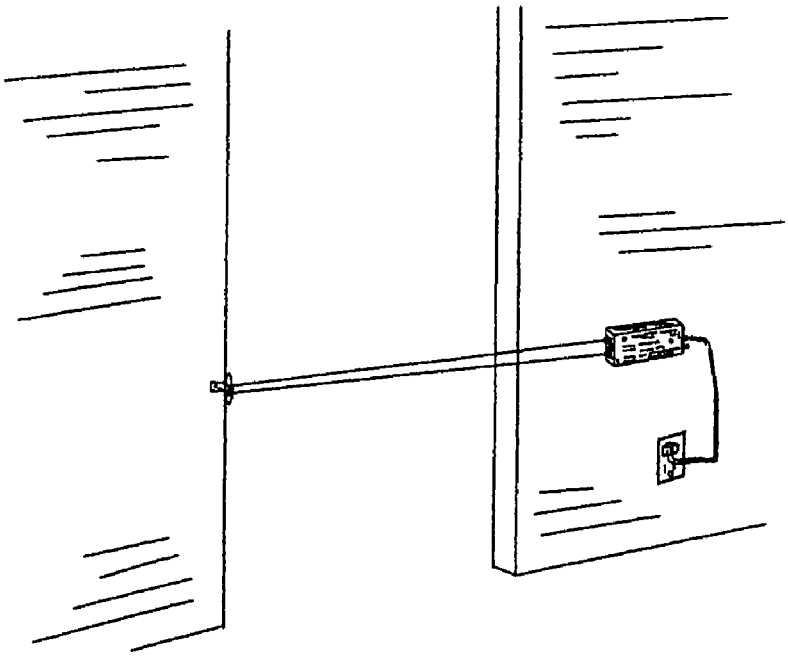
FIG. 8 shows the base unit adhered to the wall with double-sided adhesive tape.

FIGS. 7 and 8—Embodiments

In FIG. 7 the portable infrared emitter detector base unit is shown mounted to the wall using the ball joint tighten screw 28, the ball joint mounting support 30, the mounting plate 32, the support arm mounting nut 34, and the support arm 36 of the complete mounting support system (FIG. 4), and FIG. 8 shows the portable infrared emitter detector base unit mounted on a wall using a double-sided adhesive tape and aligned with external reflector 44 monitoring a doorway.

FIG. 9—Embodiment

Figure 9:
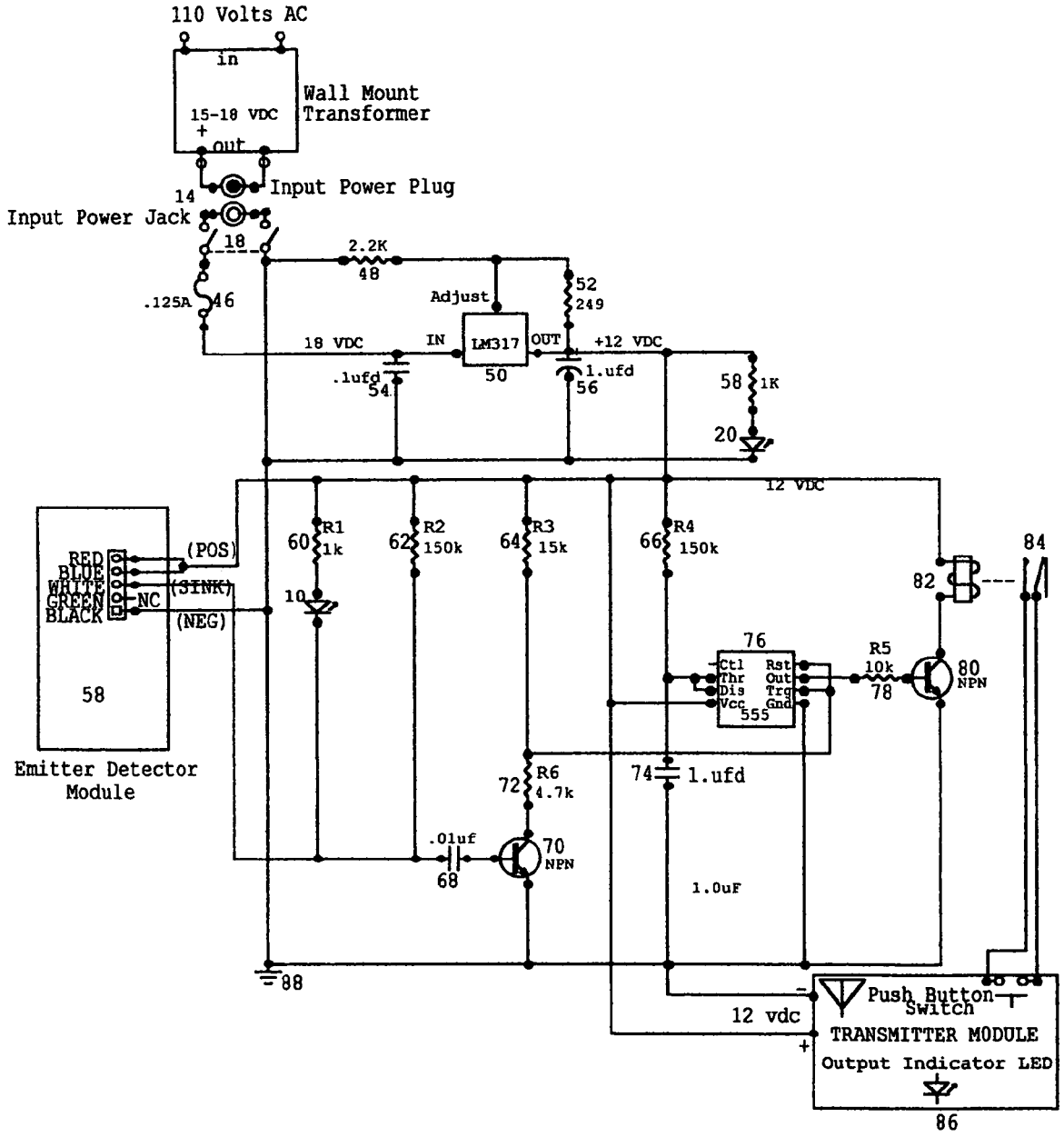
FIG. 9 shows the circuit diagram for the base unit.

Embodiment FIG. 9 shows a circuit diagram for the portable infrared emitter detector base unit. An emitter detector module 58 contains an emitter and detector (not shown) within the portable infrared emitter detector base unit which provides an npn sinking output (not shown). The output from a 110 volt alternating current household receptacle (not shown) is applied to an input of a wall mount transformer. Power input jack 14 supplies voltage to power switch 18. When power switch 18 is closed and the portable infrared emitter detector base unit is in alignment with external reflector 44, current flows through a 0.125 amp fuse 46, a 1K resistor 60, a power indicator light 20, and an LM317 voltage regulator 50 producing a regulated +12 volts direct current from the +15 to 18 volts direct current of the wall mount transformer. A 0.1 ufd capacitor 54 and a 1.0 ufd capacitor 56 provide filtering for the regulated +12 volts direct current. A 249 ohm resistor 52 and a 2.2K resistor 48 are adjustments for the regulated +12 volts direct current. The regulated +12 volts direct current is applied to a 1K resistor 60, alignment light 10, a 150K resistor 62, a 15K resistor 64, a 150K resistor 66, a relay coil 82, and red and blue terminals of emitter detector module 58. Alignment light 10 is wired directly to a collector white wire of emitter detector module 58. In this conduction state, alignment light 10 is illuminated indicating the narrow, infrared beam emitting from the emitter (not shown) of the emitter detector module 58 within the portable infrared emitter detector base unit is in alignment with external reflector 44. A 0.01 ufd capacitor 68 blocks any direct current voltage from reaching the base of an npn transistor 70, therefore, no current flows and the rest of the circuit is in a nonconductive state silencing adjustable audio alarm 26 (FIG. 10). When the narrow, infrared beam emitting from the emitter (not shown) in the emitter detector module 58 is obstructed or blocked from reaching external reflector 44 and the detector (not shown) in the emitter detector module 58, the collector white wire of the portable infrared emitter detector base unit is in a nonconductive state. This voltage transition from a conducting to a nonconductive state sends the voltage to the input of 0.01 ufd capacitor 68. The output of 0.01 ufd capacitor 68 to npn transistor 70 is a positive pulse which triggers npn transistor 70 into conduction.

A 15K resistor 64 and a 4.7K resistor 72 serve as a voltage divider and pull-up resistor for npn transistor 70. When a signal is not present at the base of npn transistor 70, the voltage between 15K resistor 64 and 4.7K resistor 72 is held high applying the voltage to reset and trigger terminals of 555 timer 76 holding it in an off position.

When a signal is present at the base of npn transistor 70, this transistor starts to conduct through its emitter to ground 88. The voltage between 15K resistor 64 and 4.7K resistor 72 drops to almost zero providing a negative voltage pulse which is applied to the reset and trigger terminals of a 555 timer 76 activating the timer. A 150K resistor 66 and a 1.0 ufd capacitor 74 determine the on-time of 555 timer 76. This delay time is necessary to eliminate intermittent triggering and insures an npn transistor 80 energizes relay coil 82, relay contacts 84, and transmitter module 86 which responds to any object obstructing the narrow, infrared beam from reaching external reflector 44.

The output of 555 timer 76 is applied to base of npn transistor 80 through 10K resistor 78. This applied voltage from the output of wall mount transformer through LM317 voltage regulator 50 is applied to the collector of npn transistor 80 through relay coil 82. The circuit is completed through an emitter of npn transistor 80 to ground 88. completing the circuit. The current flowing through npn transistor 80 develops a magnetic field energizing relay coil 82 which pulls relay contacts 84 to the closed position. Relay contacts 84 are wired directly to a push button switch in transmitter module 86. The relay contacts 84 are now in the closed position shorting the transmitter push button switch located on transmitter module 86 at the same time turning on a transmitter (not shown) in transmitter module 86 emitting a 315 Mhz frequency signal. This wireless pulse modulated signal from transmitter module 86 is received by a receiver module 104 (FIG. 10).

FIG. 10—Embodiment

The circuit diagram for the portable receiving unit is represented in FIG. 10. Receiver module 104 is powered by a separate wall mount transformer through power input jack 14 which is activated and deactivated by power switch 18 and provides a +15 to 18 volts direct current unregulated voltage to LM317 voltage regulator 94. The output of regulator 94 is a regulated +12 volts direct current and a 0.125 amp fuse 90 protects the circuitry. Filtering is achieved with a 0.1 ufd capacitor 92 and a 1.0 ufd capacitor 100. A 2.2K resistor 98 and a 249 ohm resistor 96 adjusts the regulated +12 volts direct current.

The +12 volt direct current output is monitored by power indicator light 20 and a 1K resistor 102. A receiver module 104 has five terminals which include +12 volts direct current, ground, common, normally open, and normally closed relay contacts. When power switch 18 is closed, a regulated +12 volts direct current is applied through 1K resistor 102 to power indicator light 20 illuminating power indicator light 20. The common relay contact of receiver module 104, a 1K resistor 106, plus side of adjustable audio alarm 26, push button reset switch 24, and a silicon controlled rectifier 108 are supplied with the regulated +12 volts direct current simultaneously. This circuit is not energized until a pulse modulated signal is received from the transmitter (not shown) in transmitter module 86 (FIG. 9). When the 315 Mhz pulse modulated signal is received from the transmitter (not shown) within the transmitter module 86 (FIG. 9) to the antenna (not shown) of receiver module 104, the common contact of receiver module 104 is momentarily shorted to the normally open contact of receiver module 104 and +12 volts direct current is applied through a 1.5K resistor 110 to a gate of silicon controlled rectifier 108 which completes this circuit to ground 112 producing a current flow through 1K resistor 106. The voltage drop across 1K resistor 106 energizes adjustable audio alarm 26 which emits a frequency tone of 2900 Hz at 90 db alerting a caregiver. A manual shutter (not shown) on the adjustable audio alarm 26 provides variable attenuation up to 20 db of the alarm. The alarm will sound until the normally closed push button reset switch 24 is momentarily opened removing the voltage from the anode of scr 108. Once the anode voltage of silicon controlled rectifier 108 has been removed, it will not conduct until voltage is applied to the gate of silicon controlled rectifier 108 from receiver module 104. This complete cycle is repeated every time there is a pulse modulated signal from the transmitter (not shown) within the transmitter module 86 (FIG. 9) of the portable infrared emitter detector base unit and received by receiver module 104 in the portable receiving unit.

Advantages

A number of advantages become apparent of our detection warning system for caregivers in a home:

(a) Our detection warning system may be placed in any area of a home and is completely independent eliminating the need to be retrofitted into an existing alarm system. The portable receiving unit will operate anywhere in a home within approximately 300 feet of the base unit. Until the push button reset switch located on the receiving unit is pushed, the alarm will sound continuously assuring the caregiver is alerted, even while sleeping.

(b) The base unit emits the narrow, infrared beam which enables a person to approach the detection area without triggering the alarm. This includes a caregiver being able to approach an individual's bedside. This would not be possible with a fan-shaped zone detection system.

(c) Our detection warning system may be placed anywhere in a room adjacent to the bed allowing the individual to move or sit up in the bed without triggering the alarm. A pressure pad monitor placed under a patient in a bed restricts movement and is prone to false triggering of the alarm.

(d) Our complete mounting support system allows the base unit to be pivoted about 360 degrees to any desirable position. This enables a caregiver to easily align the base unit with the external reflector and also affords the convenience of mounting the base unit on a headboard of a bed, wall or any desirable flat surface either temporarily or permanently, which eliminates the need for professional installation. A caregiver has the choice of utilizing the double-sided adhesive tape or the complete mounting support system.

(e) We have incorporated emitter detector, transmitter, and receiver modules in our design. To embody all the individual electronic components necessary to manufacture an electronic instrument, some of which include an emitter, detector, optics, transmitter, and receiver, would not be cost effective. When designing a system, design time, size, power, component selection, functionality, flexibility, availability, pricing, ease of manufacturing, and time to market are essential for the success of a product. Module design provides these features plus quality, proven reliability, trouble-free operation, and features not inherent in individual component design.

(f) A change of the lens determines the best sensing mode of detection either retroreflective or polarized retroreflective. Retroreflective mode incorporates a narrow, infrared beam which may be influenced by ambient light sources reaching the detector (not shown) at a sensing range of approximately 20 feet. Polarized retroreflective mode incorporates a narrow, infrared beam which ignores ambient light sources which ensures only the narrow, infrared beam reaches the detector, however, reduces the sensing range to approximately 10 feet. Should the lens be damaged, they are inexpensive, easy to replace, and eliminate the need to purchase a new portable infrared emitter detector base unit.

(g) Our detection warning system will safely operate on any UL listed wall mount transformer with a direct current output of +15–18 volts and a current rating of 200 ma. This system will also safely operate on any +18 volt direct current 200 ma. battery power pack (not shown). This allows a caregiver the option of using either the wall mount transformer or the battery power pack (not shown). The battery power pack (not shown) may be used for short term needs as well as backup power in case of an alternating current power failure. This allows greater portability of our system.

(h) Fire retardant plastic enclosures are of prime importance. Our enclosures housing the detection warning system for caregivers in a home are manufactured of fire retardant, nonslip abs plastic. Our system also incorporates inexpensive fuses in case of a circuit malfunction and possible fire hazard prevention.

(i) If the narrow, infrared beam of the portable infrared emitter detector base unit becomes out of alignment with the external reflector, the portable receiving unit's adjustable audio alarm will sound and the alignment light will not be illuminated. This safety feature will summon a caregiver that a problem has occurred.

(j) The portable infrared emitter detector base unit incorporates a pulse modulated narrow, infrared beam which eliminates outside interference.

(k) After extensive testing in the lab and in homes, our prototype detection warning system for caregivers in a home has proven to be safe and reliable. As a result, this system is ready for immediate production.

Operation—FIGS. 1A, 1B, 3, 5, 6, 7, and 8

The procedure for operating our detection warning system for caregivers in a home is a simple operation. Our detection warning system, both the portable infrared emitter detector base unit (FIGS. 1A and 1B) and the portable receiving unit (FIG. 3), are powered by separate wall mount transformers supplying rectified +15–18 volts direct current output and regulated to +12 volts direct current utilizing the 110 volt alternating current receptacle and may be powered by alternate +18 volt direct current battery power pack (not shown).

The narrow, infrared beam, emitter, and a detector within the emitter detector module are housed in the front section of the portable infrared emitter detector base unit (FIG. 1A). The alignment light is located on top of the portable infrared emitter detector base unit (FIGS. 1A and 1B).

A power switch, power indicator light, and a power input jack are located on the rear of the portable infrared emitter detector base unit (FIG. 1B). The portable receiving unit is housed in a separate enclosure (FIG. 3).

The adjustable audio alarm is located on the front of the portable receiving unit (FIG. 3). The receiving indicator light is located on the top of the portable receiving unit (FIG. 3). The power switch, power indicator light, and the power input jack are located on the rear of the portable receiving unit (FIG. 3). To use the detection warning system for caregivers in a home:

(a) place the portable infrared emitter detector base unit in a predetermined location (FIGS. 1A and 1B).

(b) plug the wall mount transformer into the proper 110 volt alternating current receptacle (FIGS. 1A and 1B).

(c) place the power switch of the portable infrared emitter detector base unit in the up position (FIG. 1B). The power indicator light will illuminate (FIGS. 1A and 1B).

(d) place the external reflector in front of the portable infrared emitter detector base unit at a predetermined distance (FIGS. 5, 6, 7 and 8). When the alignment light on top of the portable infrared emitter detector base unit illuminates, the external reflector and narrow, infrared beam are in alignment.

(e) place the portable receiving unit in a remote area (FIG. 3). Plug the wall mount transformer into the proper 110 volt alternating current receptacle (FIG. 3).

(f) place the power switch in the up position. The power indicator light will illuminate (FIG. 3).

(g) pass an opaque object in front of the portable infrared emitter detector base unit or the external reflector to interrupt the narrow, infrared beam (FIG. 1A). The transmit light will briefly come on indicating the portable infrared emitter detector base unit is working properly and the alignment light will momentarily go out (FIGS. 1A and 1B).

(h) the adjustable audio alarm on the portable receiving unit will sound immediately when the narrow, infrared beam from the portable infrared emitter detector base unit has been interrupted, triggering the transmitter (not shown) in the portable infrared emitter detector base unit. When the push button reset switch on top of the portable receiving unit is pressed, the adjustable audio alarm (FIG. 3) will be silenced.

Conclusion, Ramifications and Scope

Our detection warning system for caregivers in a home can detect an individual exiting a specific area and simultaneously alert a caregiver with a continuous audio alarm. This system is proven reliable, easy and convenient to operate, compact and portable, economical to manufacture, and operates on household current or a direct current battery power pack (not shown). To accommodate for different sensing ranges, two distinct modes of detection may be accomplished without requiring a new detection warning system by a simple change of the lens. In addition, our detection warning system may be placed anywhere in a home without being retrofitted into an existing alarm station, may be mounted in a vertical or horizontal position and pivoted about 360 degrees for easy alignment without impairing the ability to detect. Furthermore, the detection warning system for caregivers in a home has additional advantages:

- it permits a caregiver to enter the room or approach an individual's bedside without interrupting the narrow, infrared beam;
- it permits the detection warning system to be placed anywhere in a home by incorporating a signal which can travel through walls and floors;
- it permits the choice of alternating current or direct current power by supplying a power input jack for an alternating current/direct current wall mount transformer or a direct current battery power pack (not shown) which may be used for short term use or in case of a power failure;
- it permits a caregiver to easily identify trouble areas by incorporating transmit, receive, alignment, and power indicator lights;
- it allows easy alignment and placement of the system and may be mounted temporarily or permanently on many surfaces by utilizing the complete mounting support system or the double-sided adhesive tape; it allows height and angle adjustments to accommodate the detection of children, physically challenged individuals, and pets;
- it allows a choice of the sound level and continuous or intermittent tone of the adjustable audio alarm;
- it allows the system to be remotely reset;
- it provides additional safety features such as a fuse and fire retardant enclosures;
- it provides a narrow, infrared beam which is not affected by dirt or dust;
- it provides a pulse modulated transmitted signal which is not influenced by outside interference;
- it provides an approximate 500 microsecond alarm response to the interrupted narrow, infrared beam.

The above description provides a few of the illustrations of the presently preferred embodiments. They should not be construed as limiting the scope of our invention. Various changes may be made regarding the detailed description without altering the original invention. Therefore, the invention may be used and modified otherwise than as specifically described.

The invention claimed is:

1. A detection warning system for caregivers in a home designed and proven to operate independently from external electronics comprising of a portable infrared emitter detector base unit, wherein said portable infrared emitter detector base unit having an emitter detector module, said emitter detector module having an emitter, a portable receiving unit utilizing an electrical wall receptacle and an external reflector, wherein said emitter emitting a narrow infrared beam to an external reflector, said external reflector reflecting said narrow infrared beam back to a detector, said detector containing means for illuminating an alignment light in said portable infrared emitter detector base unit; and wherein said emitter detector module having a transistor sink output, said transistor sink output is coupled through a capacitor to a transistor within said portable infrared emitter detector base unit.

2. The detection warning system of claim 1 wherein said portable infrared emitter detector base unit having a power input jack, said power input jack providing input from a wall mount transformer, said wall mount transformer converts said electrical wall receptacle voltage to 18 volts direct current to said portable infrared emitter detector base unit.

3. The detection warning system of claim 2 wherein said power input jack providing input from an optional 18 volts direct current battery power pack to said portable infrared emitter detector base unit.

4. The detection warning system of claim 1 wherein said portable infrared emitter detector base unit having a power switch, inline fuse, and power indicator light, said power switch providing activation and deactivation of said 18 volts direct current, said inline fuse providing circuit protection, said power indicator light providing illumination to indicate when power is applied to said portable infrared emitter detector base unit.

5. The detection warning system of claim 1 wherein said portable infrared emitter detector base unit having a voltage regulator, said voltage regulator having capacitors and resistors, said capacitors and resistors regulate and filter said 18 volts direct current to an operating voltage of 12 volts direct current.

6. The detection warning system of claim 1 wherein said portable infrared emitter detector base unit having a lens, changing said lens provides two detection modes, retroreflective and polarized retroreflective.

7. The detection warning system of claim 1 wherein said transistor is held in a nonconductive state through a resistor until receiving a signal from said emitter detector module, said signal rendering said transistor in a conductive state within said portable infrared emitter detector base unit.

8. The detection warning system of claim 7 wherein said transistor sending a negative pulse activating a timer, said timer having a capacitor and resistor providing a delay time to said timer in said portable infrared emitter detector base unit.

9. The detection warning system of claim 8 wherein said timer having an output transistor, said output transistor energizing a relay coil, said relay coil having relay contacts, said relay contacts closing a switch in a transmitter module within said portable infrared emitter detector base unit.

10. The detection warning system of claim 9 wherein said transmitter module sending a transmitted signal to a portable receiving unit, said transmitted signal illuminating a transmit light in said transmitter module in said portable infrared emitter detector base unit.

11. The detection warning system of claim 1 wherein said portable receiving unit having a power input jack, said power input jack providing input from a wall mount transformer, said wall mount transformer converting said electrical wall receptacle voltage to 18 volts direct current to said portable receiving unit.

12. The detection warning system of claim 11 wherein said power input jack providing input from an optional 18 volts direct current battery power pack to said portable receiving unit.

13. The detection warning system of claim 1 wherein said portable receiving unit having a power switch, inline fuse, and power indicator light, said power switch providing activation and deactivation of said 18 volts direct current, said inline fuse providing circuit protection, said power indicator light providing illumination to indicate when power is applied to said portable receiving unit.

14. The detection warning system of claim 1 wherein said portable receiving unit having a voltage regulator, said voltage regulator having capacitors and resistors, said capacitors and resistors regulating and filtering said 18 volts direct current to an operating voltage of 12 volts direct current.

15. The detection warning system of claim 1 wherein said portable receiving unit receiving said transmitted signal from said transmitter module, said transmitted signal closing relay contacts within a receiver module within said portable receiving unit, said relay contacts transferring said operating voltage of 12 volts direct current through resistors to an anode and a gate of a silicon controlled rectifier in said portable receiving unit.

16. The detection warning system of claim 15 wherein said gate of said silicon controlled rectifier receiving said operating voltage of 12 volts direct current shorts said anode to a cathode of said silicon controlled rectifier providing circuit completion to ground of said portable receiving unit.

17. The detection warning system of claim 16 wherein said completed circuit of said portable receiving unit developing a voltage drop across a resistor in series with said anode, said voltage drop across a resistor in series with said anode energizing and sounding an adjustable audio alarm in said portable receiving unit.

18. The detection warning system of claim 16 wherein said silicon controlled rectifier having a push button reset switch in series with said anode, said push button reset switch removing said operating voltage of 12 volts direct current from said anode opening the circuit and silencing said adjustable audio alarm of said portable receiving unit.

* * * * *